United States Patent [19]

Kobayashi et al.

[11] Patent Number: 4,770,720

[45] Date of Patent: Sep. 13, 1988

[54] METHOD FOR PRODUCING A GRAIN-ORIENTED ELECTRICAL STEEL SHEET HAVING A LOW WATT-LOSS

[75] Inventors: Hisashi Kobayashi; Eiji Sasaki; Katsuo Eto; Takeo Nishimura, all of Kitakyushu, Japan

[73] Assignee: Nippon Steel Corporation, Tokyo, Japan

[21] Appl. No.: 890,145

[22] PCT Filed: Nov. 11, 1985

[86] PCT No.: PCT/JP85/00627

§ 371 Date: Sep. 5, 1986

§ 102(e) Date: Sep. 5, 1986

[87] PCT Pub. No.: WO86/02950

PCT Pub. Date: May 22, 1986

[30] Foreign Application Priority Data

Nov. 10, 1984 [JP] Japan ..... 59-236974

[51] Int. Cl.[4] ..... H01F 1/02

[52] U.S. Cl. ..... 148/111; 148/112; 148/120; 148/121

[58] Field of Search ..... 148/111, 112, 120, 121

[56] References Cited

U.S. PATENT DOCUMENTS

| | | | |
|---|---|---|---|
| 3,647,575 | 3/1972 | Fiedler et al. | 148/121 |
| 3,990,923 | 11/1976 | Takashina et al. | 148/112 |
| 4,203,784 | 5/1980 | Kuroki et al. | 148/111 |
| 4,318,758 | 3/1982 | Kuroki et al. | 148/111 |
| 4,533,409 | 8/1985 | Benford | 148/111 |
| 4,548,656 | 10/1985 | Kimoto et al. | 148/112 |
| 4,554,029 | 11/1985 | Schoen et al. | 148/112 |

FOREIGN PATENT DOCUMENTS

| | | | |
|---|---|---|---|
| 53-137016 | 11/1978 | Japan . | |
| 57-47829 | 3/1982 | Japan | 148/111 |
| 58-61225 | 4/1983 | Japan . | |
| 58-26405 | 6/1983 | Japan . | |

*Primary Examiner*—John P. Sheehan

*Attorney, Agent, or Firm*—Kenyon & Kenyon

[57] ABSTRACT

Grooves are formed on a finish-annealed electrical steel sheet by applying a mean load of from 90 to 220 kg/mm$^2$ to the steel sheet, which is then heat treated at a temperature of 750° C. or higher, and thereby fine crystal grains are generated at the strain-introduced sites of the steel sheet. The fine crystal grain reduces the watt-loss value. Such a watt-loss improving effect is not impaired even by stress-relief annealing.

9 Claims, 7 Drawing Sheets

(X 320)

(X 7)

METHOD FOR PRODUCING A GRAIN-ORIENTED ELECTRICAL STEEL SHEET HAVING A LOW WATT-LOSS

TECHNICAL FIELD

The present invention relates to a method for producing a grain-oriented electrical steel sheet having a low watt-loss, wherein the magnetic characteristics are not impaired even by stress-relief annealing.

BACKGROUND ART

In recent years, from a viewpoint of saving energy, it has been desired to reduce watt-loss in electrical steel sheets. As a method for reducing the watt-loss, a subdivision of magnetic domains by laser irradiation has already been disclosed in Japanese examined Patent Publication (Kokoku) No. 58-26405. The reduction of watt-loss by this method is due to strains introduced by laser irradiation. Therefore, the method can be applied to a laminated-core type transformer wherein no stress-relief annealing is necessary, but cannot be applied to a wound-core type transformer wherein stress-relief annealing is necessary. Also, Japanese Unexamined Patent Publication (Kokai) No. 59-100222 discloses a method wherein a steel sheet subjected to secondary recrystallization annealing is locally heat-treated and annealed at a temperature of 800° C. or higher, whereby grain boundaries are artificially introduced. In this method, the reduction of watt-loss value is achieved by the subdivision of magnetic domains by the artificial grain boundaries introduced into the steel sheet. The watt-loss reduction effect does not disappear even upon stress-relief annealing, because the steel sheet is annealed at a temperature of 800° C. or higher. However, the disclosed examples indicate it is difficult to obtain a watt-loss comparable with that in the above-mentioned method for reducing the watt-loss value by laser irradiation.

DISCLOSURE OF THE INVENTION

The present invention provides a grain-oriented electrical steel sheet having a low watt-loss wherein the magnetic characteristics are not impaired even upon stress-relief annealing, through simultaneously resolving the difficulties arising because, when stress-relief annealed, the reduction of watt-loss cannot be achieved because the introduced strains disappear and because, even though the watt-loss reduction effect does not disappear upon stress-relief annealing, a watt-loss value comparable with that of the laser irradiation method cannot be obtained.

In the present invention, in order to solve the above-mentioned difficulties, a steel sheet subjected to final-texture annealing or insulation coating application is given a work strain in the form of a dotted or broken line with a gear type roll, for example, at a mean load of 90 to 220 kg/mm$^2$, and then annealed at a temperature of 750° C. or higher so that fine recrystallized grains are formed within the crystal grains to cause a subdivision of the magnetic domains. Thus, the present invention provides a grain-oriented electrical steel sheet having an excellent watt-loss value comparable with or lower than that of the laser irradiation method even when subjected to stress-relief annealing.

The present invention will be described in detail below.

A slab containing Si up to 4% is heated and hot-rolled to an intermediate thickness. The hot-rolled steel sheet is subjected to pickling, heat-treated in accordance with a need therefor at this stage, and then cold-rolled twice with an intermediate annealing or once to a final sheet thickness. The cold-rolled steel sheet is subjected to a usual process whereby the grain-oriented electrical steel sheet is produced, which consists of the steps of decarburization annealing, annealing-separator application, and secondary recrystallization annealing. The steel sheet may be then applied with a coating liquid for forming a phosphoric-acid tension-imparting coating or other insulation coatings, and baked. The thus obtained steel sheet is given a working at a load of 90 to 220 kg/mm$^2$ in terms of the mean load at the stress-applied sites (the quotient of the applied stress divided by the stress-imparted area on the steel sheet viewed normally to the sheet surface--the stress-imparted area on the sheet surface after stress impartation).

The present inventors found that locally loading the above-mentioned steel sheet causes a generation of fine grains at the strain-introduced sites and that the size of the fine grains, i.e., the magnitude of loading, has a close relationship to the watt-loss value and the magnetic flux density.

BRIEF EXPLANATION OF THE DRAWINGS

FIG. 1 shows the relation of the imparted mean stress to the watt-loss and the magnetic flux density. As shown in this figure, it is obvious that both the watt-loss ($W_{17/50}$ (W/kg)) and the magnetic flux density ($B_8$(T)) are improved when the mean load falls in the range from 90 to 220 kg/mm$^2$. That is, when the mean load is less than 90 kg/mm$^2$, the amount of strain introduced is too small to generate fine grains or, even if fine grains are generated, the magnetic-domain subdividing effect is weak. On the other hand, the amount of strain introduced when 220 kg/mm$^2$ is exceeded is so excessive that the recrystallized grains out of Goss-orientation at the strain-introduced sites grow with the resulting reduction of the magnetic flux density. The most preferable range of the mean load is from 120 to 180 kg/mm$^2$.

FIG. 2 shows a state of the fine grains generated at the strain-introduced sites after introducing strain and heat-treating. (The photograph was taken at a magnification of 320.) The mean load was 130 kg/mm$^2$ and heat treatment was performed at 850° C. for 4 hours.

The size of these fine grains is 100 $\mu$m. Nuclei to subdivide the magnetic domains are generated at the interfaces between these fine grains and the secondary recrystallized grains. The nuclei of magnetic domains generated from these grains were 2 to 3 mm long.

Figure 1:
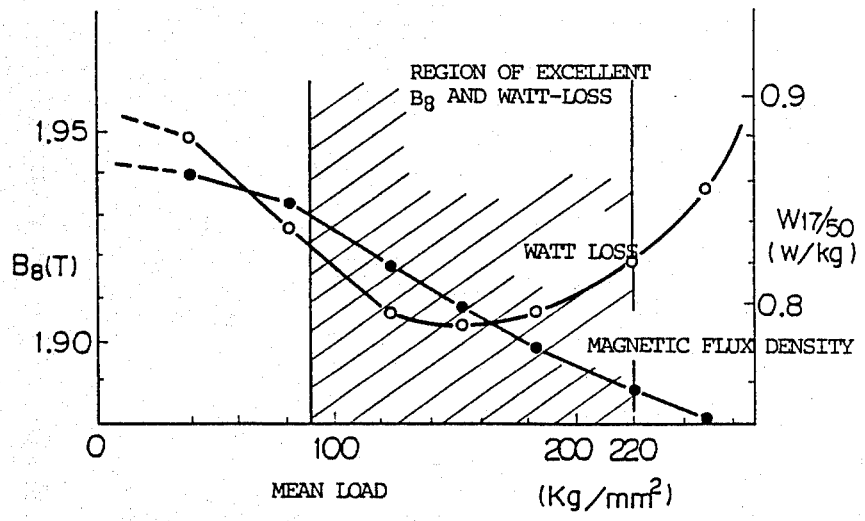
FIG. 1 is a graph showing the relationship between the mean load for introducing strains into a steel body and magnetic characteristics.
Figure 2:
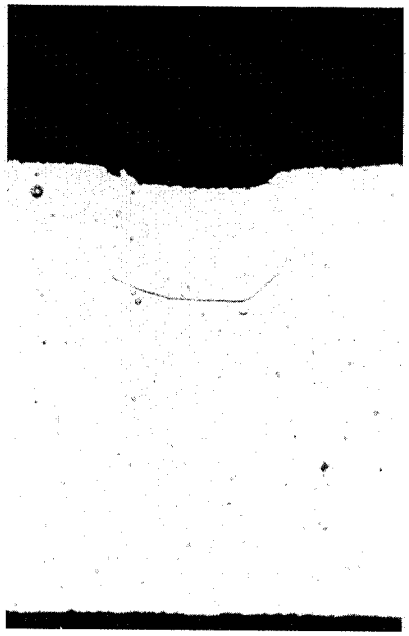
FIG. 2 is a photograph showing a metallurgical microstructure at a strain-introduced site after heat treatment.

When fine grains such as seen in FIG. 2 are generated, the reduction of magnetic flux density is small and, further, the watt-loss value is considerably improved by the generation of nuclei of magnetic domains. When grains so grow as to penetrate the thickness of sheet, the magnetic flux density is considerably lowered. According to the present invention, a $B_8$ of 1.878 T or more and a $B_{10}$ of 1.89T or more can be obtained without significantly impairing the magnetic flux density, and there is a feature that the fine grains with a proper size can be introduced into the secondary-recrystallized grains.

Figure 3:
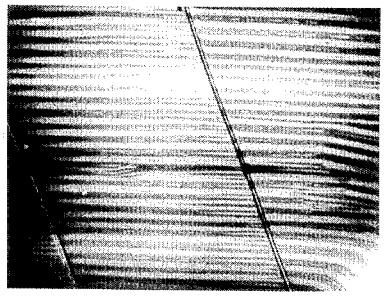
FIG. 3 is a photograph by scanning electron microscope showing a crystal structure of the magnetic domains at a strainintroduced site.

FIG. 3 shows a state of the subdivision of magnetic domains. (The photograph was taken at a magnification of 7.) This figure shows a state of the magnetic domains in the steel sheet by a scanning electron microscope, where it is seen that the nuclei of magnetic domains are generated at the strain-introduced sites and thereby the magnetic domains are subdivided.

The optimum shape of the stress-imparted portion of groove by such an impartation of mean load onto the steel sheet is as follows:

First, the interval of grooves in the rolling direction is preferably from 1 to 20 mm. The most preferable range is from 2.5 to 10 mm, in which range the watt-loss value is effectively reduced.

Next, the width of the groove is preferably in the range from 10 to 300 μm. If the grooves are too narrow, a notch effect will result in any easy breaking when subjected to a bending-working at a small curvature of radius. On the other hand, if the grooves are too wide, the magnetic flux density will be lowered. Therefore, the width of grooves is preferably in the above-mentioned range. The most preferable range is from 10 to 150 μm. When a gear type roll is used to form grooves, from the viewpoint of magnetic characteristics, the gear tip may be flat, with a curvature of radius, or sharp, but is not preferably such as will cause a stress concentration at the grooves when subjected to bending-working. However, this limitation does not apply when bending-working is not performed. When bending-working is to be applied, the shape of the groove root is preferably flat or with a curvature of radius.

Figure 4:
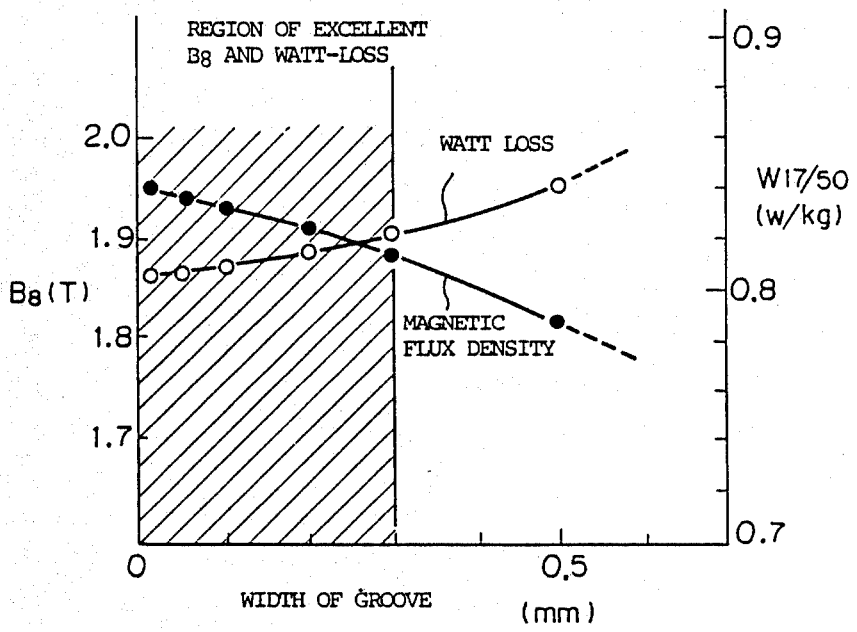
FIGS. 4 and 5 are graphs showing the relationship between the width of a groove formed on a steel sheet and magnetic characteristics.
Figure 5:
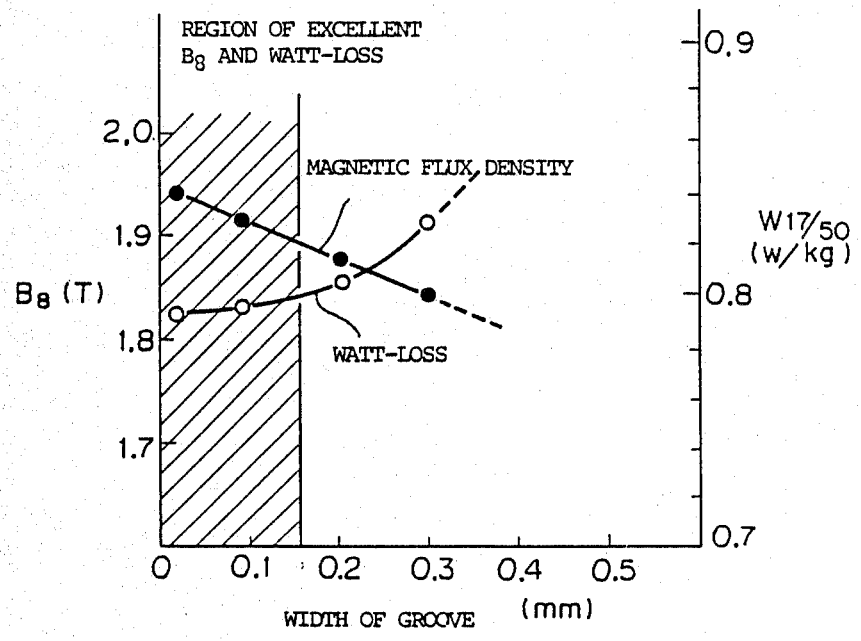

FIGS. 4 and 5 show the relation of the above-mentioned width of groove to the watt-loss and the magnetic flux density.

FIG. 4 shows the relationship between the width of groove (mm) and magnetic characteristics under the conditions of a steel sheet thickness of 0.23 mm, a mean load of 100 kg/mm$^2$, an interval of grooves of 5 mm, a gear tip having a flat shape, and heat treatment at 850° C. for 4 hours, which shows that the optimum range of the width of groove is up to 0.3 mm.

FIG. 5 shows the relationship between the width of groove and magnetic characteristics under the conditions of a steel sheet thickness of 0.23 mm, a mean load of 200 kg/mm$^2$, an interval of grooves of 7 mm, a flat shape gear tip, and heat treatment at 850° C. for 4 hours, which shows that the optimum range of the width of groove is up to 0.15 mm. That is, the width of groove varies according to the load and when the width is increased excessively, grains out of Goss-orientation at the strain-introduced sites grow with a resulting impairment of magnetic characteristics. Thus, when the mean load is from 90 to 220 kg/mm$^2$, the preferable width of the groove is 300 μm or less and the minimum width upon working is 10 μm.

Figure 6:
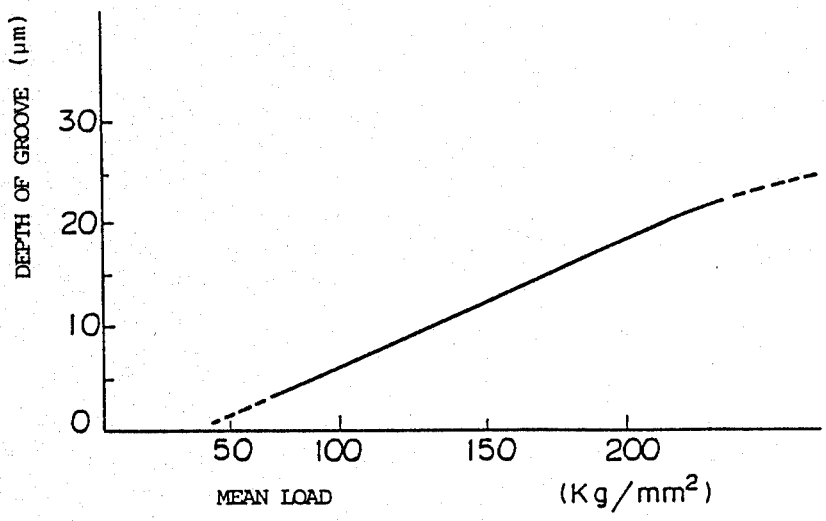
FIG. 6 is a graph showing the relationship between the load for introducing strains and the depth of the groove.

The depth of the grooves into the steel body is preferably more than 5 μm. The depth increases with the increasing load imparted on the steel sheet. FIG. 6 shows the relationship between the mean load and the depth of groove under the conditions of a steel sheet thickness of 0.23 mm, a width of groove of 50 μm, and a flat shape gear tip, which shows that, when the mean load is from 90 to 220 kg/mm$^2$, the depth of groove is from 5 to 20 μm. Grooves are preferably directed at an angle between 45° and a right angle to the rolling direction (<001> orientation). An excessively large angle will cause a disadvantage in the reduction of the watt-loss value.

The groove may be in the form of a dotted, broken, or solid line. The interval of dots or lines in the direction perpendicular to the rolling direction is preferably 0.1 mm or less. When the interval exceeds this value, the magnetic-domain subdividing effect of the fine grains formed by strain introduction is decreased.

Figure 7:
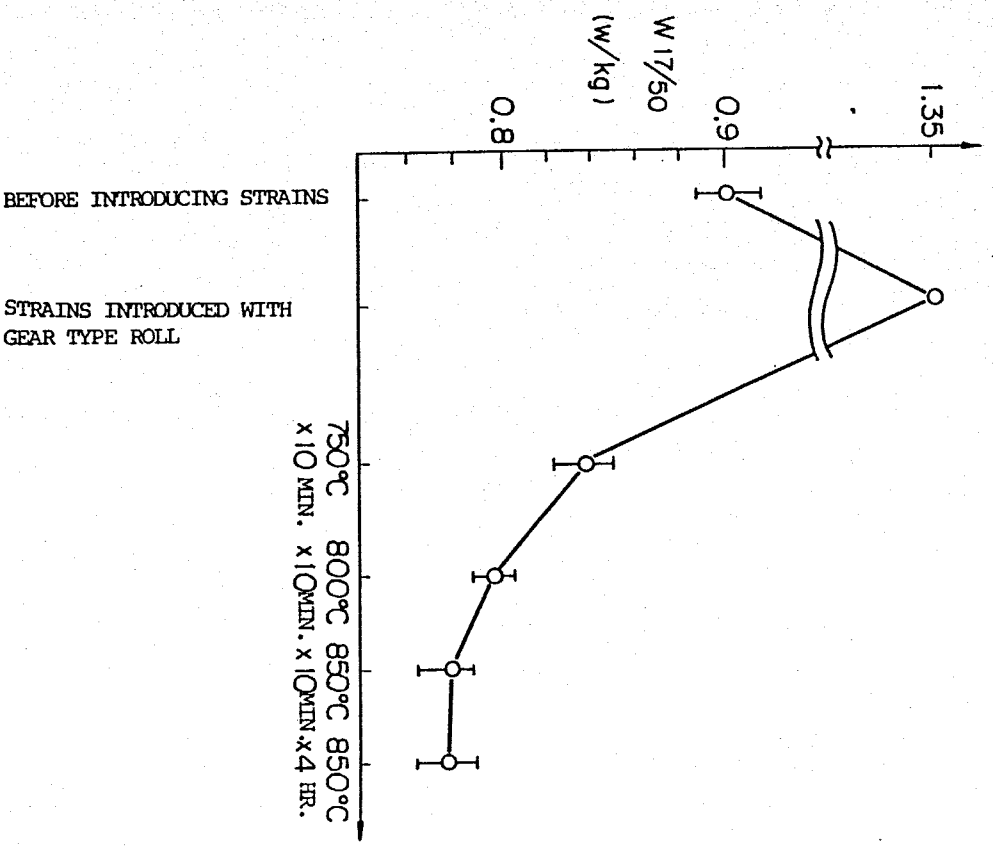
FIGS. 7 and 8 are graphs showing variations of the magnetic characteristics before and after the strain introduction and those after the heat treatment.
Figure 8:
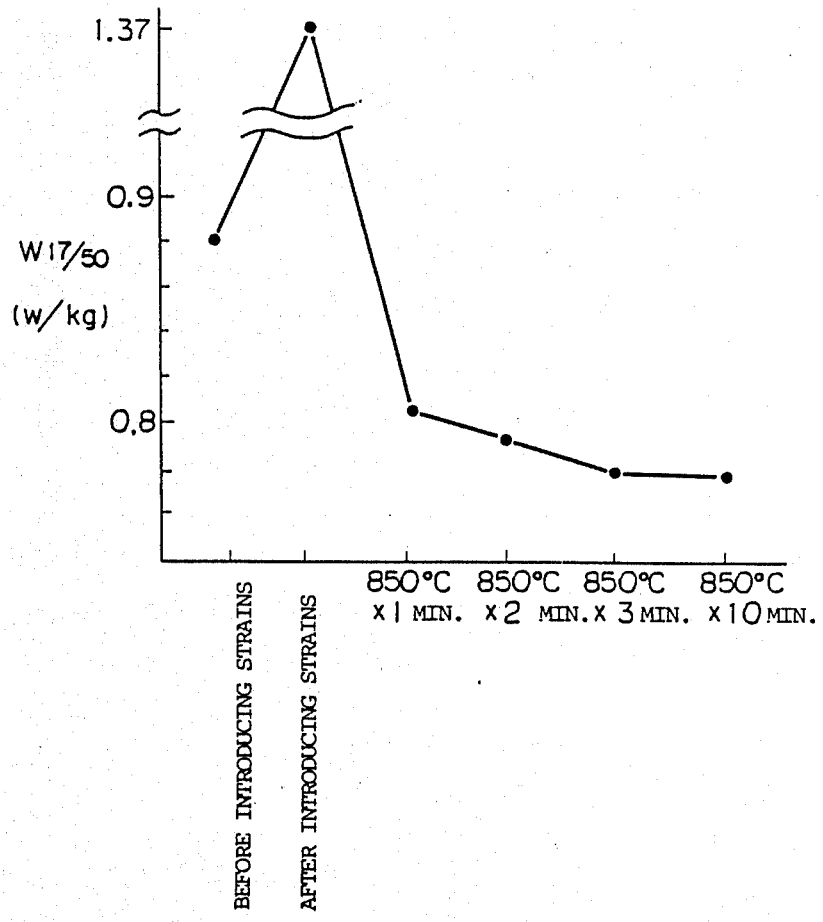

In the present invention, the strain introduction by load impartation is followed by heat treatment at a temperature of 750° C. or higher. FIGS. 7 and 8 show the variation of the watt-loss value ($W_{17/50}$ (W/kg)) upon heat treatment after the strain introduction.

As seen from these figures, the watt-loss value is once impaired after the strain introduction compared with that before the strain introduction, but is extremely improved by a short-time heat treatment. This makes it possible to reduce the watt-loss value before stress-relief annealing, by introducing strain after final-texture annealing and then performing the recrystallization at the strain-introduced sites by utilizing the heat treatment upon baking of an insulation coating subsequent to the strain introduction. Therefore, the method according to the present invention can also apply, of course, to the materials for the laminated-core type transformer use in which the stress-relief annealing is not performed. Additionally, supposing a short-time heat treatment is performed on a continuous line, the upper limit to the heat treatment temperature will preferably be 850° C. At temperatures exceeding 850° C. in a continuous line, the sheet tension causes an elongation. Further, since the watt-loss value is stable even after a long-time heat treatment, the method according to the present invention preferably applies to the materials for the wound-core type transformer use in which a long-time stress-relief annealing is performed.

FIG. 7 corresponds to the case of a sheet thickness of 0.23 mm, a $B_8$ of 1.94 (T) (before the strain introduction), and a strain-introducing load of 150 kg/mm$^2$. FIG. 8 corresponds to the case of a sheet thickness of 0.23 mm, a $B_8$ of 1.95 T (before the strain introduction), and a strain-introducing load of 165 kg/mm$^2$. Although a gear type roll is used to form grooves in this example, any other methods may be applied provided they can locally impose the load according to the present invention.

Additionally, when the steel sheet is locally loaded, it is practically suitable to have the steel sheet maintained at a temperature of from 50° to 500° C., since this makes it difficult for twins to be formed, and thereby the magnetic characteristics are improved.

The steel sheet with a final-texture annealing coating or a phosphoric-acid tension-imparting coating has here been described, considering the most economical manufacturing. However, the watt-loss reduction effect also can be expected when the method according to the present invention is applied to the secondarily recrystallized steel sheet which has no coating. The phosphoric-acid tension-imparting coatings mean the coatings formed by using the coating-forming liquid containing as indispensable components phosphorate, colloidal silica, and chromic acid or anhydrous chromic acid.

BEST MODE FOR CARRYING OUT THE INVENTION

Below, the examples according to the present invention will be described.

(Example 1)

A final-texture annealed grain-oriented electrical steel sheet which was finish-rolled to a thickness of 0.23 mm by single coldrolling was applied with a phosphoric-acid tensionimparting coating solution and then subjected to baking. Strain was introduced to the steel sheet by means of a gear type roll with a gear pitch of 5 mm, an edge width at gear tip of 50 μm, a flat shape gear tip, and an edge angle of 75° to the rolling direction, under an applied load of 130 kg/mm$^2$. The steel sheet after the strain introduction was subjected to stress-relief annealing at 850° C. for 4 hours. Table 1 shows the watt-loss values $W_{17/50}$ (W/kg) corresponding to the conventional method and the method of the present invention. According to the method of the present invention, an extremely excellent watt-loss value was obtained. According to the method of the present invention, worked grooves larger than 5 μm in depth are formed on the steel surface, which causes no problem in the space factor, since the grooves are concave with no convexities. In the repeated-bending test and the right-angle bending test, cracks are not initiated at the grooves because of the flatness of the groove root. The magneto-striction characteristics are also extremely excellent after heat treatment at 850° C. for 4 hours.

TABLE 1

| Method | Processing Step | $W_{17/50}$ (W/kg) |
|---|---|---|
| Conventional | Final-texture annealing, Phosphoric-acid tension-coating application, and Stress-relief annealing. | 0.90 |
| Present Invention | Processing according to the present invention, and stress-relief annealing. | 0.78 |

(Example 2)

A final-texture annealed grain-oriented electrical steel sheet was finishrolled to a thickness of 0.23 mm by single cold-rolling. Strain was introduced to the steel sheet by means of a gear type roll with a gear pitch of 8 mm, a curvature of radius at gear tip of 100 μm, and an edge angle of 75° to the rolling direction, under an applied load of 180 kg/mm$^2$. This caused grooves about 14 μm deep. The steel sheet after the strain introduction was applied with a phosphoric-acid tension-imparting coating solution and then subjected to heat treatment at 800° C. for 4 hours. Table 2 shows the watt-loss values of the above-processed steel sheet and the comparative sample.

TABLE 2

| Method | Processing Step | $W_{17/50}$ (W/kg) |
|---|---|---|
| Conventional | Final-texture annealing, Phosphoric-acid tension-coating application, and Heat treatment at 800° C. for 4 hours. | 0.91 |
| Present Invention | Processing according to the present invention, Phosphoric-acid tension-coating application, and Heat treatment at 800° C. for 4 hours. | 0.80 |

The steel sheet processed according to the present invention has an extremely excellent watt-loss value even after heat treatment.

(Example 3)

A grain-oriented electrical steel sheet was finishrolled to a thickness of 0.30 mm by single cold-rolling and then final-texture annealed. Strain was introduced to the steel sheet by means of a gear type roll with a gear pitch of 7 mm, an edge width at gear tip of 150 μm, a flat shape gear tip, and an edge angle of 60° to the rolling direction, under an applied load of 200 kg/mm$^2$. The steel sheet after the strain introduction was applied with a phosphoric-acid tension-imparting coating solution and then subjected to heat treatment at 850° C. for 5 min. Table 3 shows the watt-loss values of the above-processed steel sheet and the comparative sample.

TABLE 3

| Method | Processing Step | $W_{17/50}$ (W/kg) |
|---|---|---|
| Conventional | Final-texture annealing, Phosphoric-acid tension-coating application, and Heat treatment at 850° C. for 5 min. | 1.05 |
| Present Invention | Processing according to the present invention, Phosphoric-acid tension-coating application, and Heat treatment at 850° C. for 5 min. | 0.93 |

(Example 4)

A grain-oriented electrical steel sheet was finishrolled to a thickness of 0.20 mm by single cold-rolling and then final-texture annealed. Strain was introduced to the steel sheet by means of a gear type roll with a gear pitch of 8 mm, a curvature of radius at gear tip of 100 μm, an edge angle of 15° to the axial direction of gear, under an applied load of 150 kg/mm$^2$. The temperatures of the steel sheet upon the strain introduction were (1) room temperature, (2) 200° C., and (3) 400° C. The steel sheet after the strain introduction was applied with a phosphoric-acid tension-imparting coating solution and then subjected to heat treatment at 850° C. for 30 sec followed by stress-relief annealing at 800° C. for 4 hours. Table 4 shows the magnetic characteristics in the above case.

TABLE 4

| Temperature of steel sheet upon strain introduction | $B_8$ (T) | $W_{13/50}$ (W/kg) | $W_{17/50}$ (W/kg) |
|---|---|---|---|
| Room temperature | 1.91 | 0.40 | 0.77 |
| 200° C. | 1.91 | 0.37 | 0.75 |
| 400° C. | 1.91 | 0.37 | 0.75 |

(Example 5)

A final-texture annealed grain-oriented electrical steel sheet was finishrolled to a thickness of 0.23 mm by single cold-rolling. Strain was introduced to the steel sheet by means of a gear type roll with a gear pitch of 5 mm, an edge width at gear tip of 50 μm, a flat shape gear tip, and an edge angle of 75° to the rolling direction, under an applied load of 130 kg/mm². The steel sheet after the strain introduction was subjected to stress-relief annealing at a temperature of 800° C. for 2 hours. Table 5 shows the watt-loss values $W_{17/50}$ (W/kg) corresponding to the conventional method and the method of the present invention. According to the present invention, an extremely excellent watt-loss value is obtained.

TABLE 5

| Method | Processing Step | $W_{17/50}$ (W/kg) |
|---|---|---|
| Conventional | Final-texture annealing, and Heat-treatment at 800° C. for 2 hours | 0.97 |
| Present Invention | Final-texture annealing, Strain introduction, and Heat-treatment at 800° C. for 2 hours | 0.82 |

CAPABILITY OF EXPLOITATION IN INDUSTRY

The steel sheet obtained by the method according to the present invention shows an extremely excellent watt-loss value. Therefore, the present invention enables an electrical steel sheet having a low watt-loss value to be obtained through a continuous line.

According to the present invention, a watt-loss value comparable to that obtained by laser irradiation can be obtained even when stress-relief annealing is performed. Therefore, the thus obtained electrical steel sheet can be used for the laminated-core type transformer as well as for the wound-core type transformer. Thus, the present invention will contribute greatly to the industry.

We claim:

1. A method for producing a grain-oriented electrical steel sheet having a low watt-loss, wherein grooves are formed on an electrical steel sheet that has been final-texture annealed, or final-texture annealed and then subjected to an insulation-coating-treatment, by locally loading at a mean load of from 90 to 220 kg/mm² at an angle in a range of from a right angle to 45° to a rolling direction, and then said steel sheet is heat-treated at a temperature of 750° C. or higher.

2. A method according to claim 1, wherein said grooves are so formed as to be spaced at an interval of from 1 to 20 mm in the rolling direction, have a width of from 10 to 300 μm, and have a depth in the steel body of 5 μm or more.

3. A method according to claim 2, wherein said grooves have an interval therebetween of from 2.5 to 10 mm.

4. A method according to claim 2, wherein said grooves have a width of from 10 to 150 mm.

5. A method according to claim 1, 2, 3, or 4 wherein each of said grooves is composed of a dotted or broken line.

6. A method according to claim 5, wherein said dotted or broken line has an interval between dots of 0.1 mm or less.

7. A method according to claim 1, 2, 3, or 4, wherein a gear type roll is used to form said grooves and each of the grooves is composed of a dotted or broken line.

8. A method according to claim 1, 2, 3, or 4, wherein said final-texture annealed electrical steel sheet after forming said grooves thereon is applied with an insulation-coating imparting solution and then heat-treated at a temperature of 750° or higher.

9. A method according to claim 7, wherein said dotted or broken line has an interval between dots of 0.1 mm or less.

* * * * *